US010329965B2

(12) United States Patent
Stays

(10) Patent No.: US 10,329,965 B2
(45) Date of Patent: Jun. 25, 2019

(54) CAMSHAFT ADJUSTER HAVING TWO BALL JOINTS

(71) Applicant: Schaeffler Technologies AG & Co. KG, Herzogenaurach (DE)

(72) Inventor: Rafael Stays, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 122 days.

(21) Appl. No.: 15/507,066

(22) PCT Filed: Jun. 18, 2015

(86) PCT No.: PCT/DE2015/200378
§ 371 (c)(1),
(2) Date: Feb. 27, 2017

(87) PCT Pub. No.: WO2016/029911
PCT Pub. Date: Mar. 3, 2016

(65) Prior Publication Data

US 2017/0254232 A1 Sep. 7, 2017

(30) Foreign Application Priority Data

Aug. 28, 2014 (DE) ..... 10 2014 217 155

(51) Int. Cl.
*F01L 1/344* (2006.01)
*F01L 1/047* (2006.01)

(52) U.S. Cl.
CPC ..... *F01L 1/344* (2013.01); *F01L 1/047* (2013.01); *F01L 1/3442* (2013.01); *F01L 2001/0473* (2013.01); *F01L 2001/34433* (2013.01)

(58) Field of Classification Search
CPC ..... F01L 1/344; F01L 1/047; F01L 1/3442; F01L 2001/34433; F01L 2001/0473
See application file for complete search history.

(56) References Cited

U.S. PATENT DOCUMENTS 8,919,308 B2 12/2014 Schober et al.

FOREIGN PATENT DOCUMENTS

DE 102007003487 7/2008
DE 102009029092 A1 * 3/2011 ..... F01L 1/022
(Continued)

OTHER PUBLICATIONS

DE 102009029092 english language machine translation.*
International Search Report of PCT/DE2015/200378, dated Dec. 11, 2015, 3 pages.

*Primary Examiner* — Mark A Laurenzi
*Assistant Examiner* — Wesley G Harris
(74) *Attorney, Agent, or Firm* — Davidson, Davidson & Kappel, LLC

(57) ABSTRACT

A camshaft adjuster (1) for variably adjusting an outer camshaft (5) and an inner camshaft (7) that is arranged concentrically thereto, including a stator (2) that can be connected to the outer camshaft (5), and a rotor (3) that is arranged concentrically to the stator (2), wherein the rotor (3) can be connected to the inner camshaft (7) in the manner of a first joint (9) on a first spherical contact surface (27). In order to axially secure the rotor (3) on the inner camshaft (7), force can be applied to the rotor (3) by way of a screw (4). The screw (4) can be connected to the inner camshaft (7) in the manner of a second joint (12) on a second spherical contact surface (28). A camshaft adjuster-camshaft combination having a camshaft adjuster, wherein the outer camshaft (5) is fixed on the stator (2) in a rotationally secured manner, and the inner camshaft (7) is fixed on the rotor (3) in a rotationally secured manner.

18 Claims, 5 Drawing Sheets

(56) References Cited

FOREIGN PATENT DOCUMENTS

| | | | | |
|---|---|---|---|---|
| DE | 102011103495 | | 12/2012 | |
| DE | 10 2012 105 284 | A1 | 12/2013 | |
| JP | WO 2006095532 | A1 * | 9/2006 | ..... F01L 1/022 |
| WO | WO2015/150175 | | 10/2015 | |

* cited by examiner

CAMSHAFT ADJUSTER HAVING TWO BALL JOINTS

The present invention relates to a camshaft adjuster for variably adjusting an outer camshaft and an inner camshaft situated concentrically thereto, including a stator which is connectable to the outer camshaft, including a rotor which is situated concentrically to the stator, the rotor being connectable to the inner camshaft in the manner of a first joint on a first spherical contact surface, and a force being applicable to the rotor via a screw for the purpose of axially securing the rotor on the inner camshaft.

BACKGROUND

Gas exchange valves of internal combustion engines may be actuated by cams of a camshaft. The opening and closing times of the gas exchange valves may be purposefully defined with the aid of the configuration and shape of the cams. The camshaft is usually actuated, driven and/or activated by the crankshaft of the internal combustion engine. The opening and closing points in time of the gas exchange valves of the internal combustion engine are usually predefined by a relative rotational position/phase angle/angular position between the camshaft and the crankshaft. A variable adjustment of the opening and closing points in time of the gas exchange valves may be achieved by a relative change in this rotational position between the camshaft and the crankshaft. Due to the variable adjustment of the opening and closing points in time of the gas exchange valves, for example the exhaust gas behavior may be positively influenced, the fuel consumption may be decreased, the efficiency may be increased, the maximum torque of the internal combustion engine may be increased and/or the maximum power of the internal combustion engine may be increased, as a function of the instantaneous operating state of the internal combustions engine.

It is customary to use two camshafts in an internal combustion engine, namely one camshaft for controlling the opening and closing points in time of inlet gas exchange valves and the other camshaft for controlling the opening and closing points in time of the outlet gas exchange valves.

The camshafts are usually situated coaxially to each other. In the present case, as a special case of the coaxial arrangement, the camshafts are to be situated or present at least partially or at least in sections, concentrically.

An (outer) part of the camshaft adjuster, referred to here as the stator, is connected to the outer camshaft. At the same time, another (inner) part of the camshaft adjuster, referred to here as the rotor, is connected to the inner camshaft. The variable adjustment of the opening and closing points in time of the gas exchange valves is achieved by a variably adjustable angle between the rotor and the stator. For example, this adjustment may be carried out hydraulically, for example via a fluid, or electrically. The present invention is to be combinable with all camshaft adjusting mechanisms.

To facilitate an undisturbed operation of the camshaft adjuster, the rotor and the stator may preferably be and remain situated concentrically. However, an offset, in particular an angle offset or an axial offset between the camshafts, may occur in concentrically arranged camshafts, for example due to manufacturing tolerances. If the stator were now to be fixedly connected to one camshaft, and if the rotor were to be simultaneously fixedly connected to the other camshaft, the necessary concentricity of the rotor and the stator could no longer be ensured. It is therefore advantageous to improve camshaft adjusters to the effect that they may compensate for or tolerate an offset, in particular an angle offset, between the concentrically arranged camshafts.

For example, the following approach is known from the related art for this purpose. DE 10 2012 105 284 A1 describes a camshaft device, which includes an inner camshaft, an outer camshaft situated concentrically thereto, a camshaft adjuster for adjusting the inner camshaft and/or the other camshaft and a compensating element situated between the inner camshaft and/or the outer camshaft, on the one hand, and the camshaft adjuster, on the other hand, the compensating element having a disk-like shape. This disk-like compensating element forms, for example, a calotte shape and is to be able to compensate for an angle offset between the camshafts. The rotor is axially connected to the inner camshaft with the aid of a central screw, a connecting piece being inserted therebetween, for example via hydraulic channels for the purpose of controlling the camshaft adjuster. Contact surfaces between the screw and the connecting piece and between the connecting piece and the rotor are plane-parallel, i.e., they extend in a radial plane of the axis of the screw, i.e., in a radial plane to the center axis of an axial end section of the inner camshaft. In particular, since or if an axial force is applied by a pretightening of the screw, it is to be assumed that the rotor is oriented toward a screw head contact surface, whereby the function of the compensating element may not be effective. It is therefore to be assumed that the disk-like compensating element is able to compensate for an angle offset only to a limited extent, due to this plane-parallelism. If the angle offset or angle error exceeds the compensatable amount, an inclination occurs, for example between the rotor and the stator, which may result, for example, in a reduced tightness, an increased friction, an increased wear and/or a jamming between the stator and the rotor.

SUMMARY OF THE INVENTION

It is an object of the present invention to provide a camshaft adjuster, in which a compensation of an offset, in particular an angle offset, is possible between the concentrically situated camshafts.

According to the present invention, the camshaft adjuster includes a screw connectable to the inner camshaft in the manner of a second (friction) joint on a second spherical contact surface. The screw may thus be connected to the rotor via a second ball joint. The screw may thus induce a compensation of an offset, in particular an angle offset, between the camshafts. A frictionless operation of the camshaft adjuster is thus ensured.

Advantageous specific embodiments are explained below. The aspects mentioned therein may also be pursued individually, independently of each other and of the main aspect.

It is thus advantageous if the first joint, also referred to below in short as a ball joint, is formed from a pair of spherically diametrically opposed or complementary joint contours. This facilitates an even contact of the rotor on the inner camshaft. With a correspondingly selected tightening moment of the (central) screw, this furthermore makes it possible to transmit a friction moment between the inner camshaft and the rotor for the rotational driving of the inner camshaft without slippage.

For the purpose of an even contact of the screw and the rotor, and for the purpose of transmitting a normal force between the screw and the rotor, it is also advantageous if the second joint, also referred to in short as the ball joint, is formed from a pair of spherically diametrically opposed or complementary joint contours.

The compensating movement to be facilitated or facilitated according to the present invention is, in particular, a wobbling movement of the rotor relative to the inner camshaft. Due to installation space considerations, the camshaft may axially project into/out of the rotor. The rotor may be equally effectively situated axially next to the camshaft. The rotor may furthermore project axially in the direction of the camshaft. In a first approximation, it is advantageous if a center point or rotation center point of the wobbling movement is situated on the rotation axis of the inner camshaft during the operation of the engine. This may be advantageously accommodated if the first ball joint is formed by a camshaft-side convex joint contour and a rotor-side concave joint contour. The first ball joint may likewise be formed by a camshaft-side concave joint contour and a rotor-side convex joint contour. It is also advantageous if the second ball joint is formed by a screw-side convex joint contour and a rotor-side concave joint contour. In a consequently advantageous manner, this may be accommodated if the ball joint is formed by a screw-side concave joint contour and a rotor-side convex joint contour. "Screw-side" is understood to mean "on the screw side."

It is advantageous if the rotor is in direct contact with the inner camshaft in the first joint, or if a first compensating part is inserted therebetween, and/or if the screw is in direct contact with the inner camshaft in the second joint, or if a second compensating part is inserted therebetween.

It is advantageous to form a ball joint geometry as a single piece on the particular part, since an assembly is facilitated and the bearing structure reduced hereby. This advantage may be used if the first ball joint is formed by the camshaft as a camshaft-side single piece, if the first ball joint is formed by the rotor as a rotor-side single piece, if the second ball joint is formed by the rotor as a rotor-side single piece and/or if the second ball joint is formed by the screw as a screw-side single piece. "Camshaft-side" is understood to mean "on the camshaft side." "Rotor-side" is understood to mean "on the rotor side."

To separate a possibly complex manufacture of the ball joint geometry or the joint contour from the manufacture of the particular part, or to obtain an ability to combine different ball joint geometries with different basic types of camshaft adjusters, it is advantageous to form a ball joint by inserting a compensating part. It may therefore be advantageous if the first ball joint is formed on the camshaft side by inserting a compensating part. The same advantage may be used if the first ball joint is formed on the rotor side by inserting a compensating part, if the second ball joint is formed on the rotor side by inserting a compensating part, and/or if the second ball joint is formed on the screw side by inserting a compensating part.

It is advantageous if the first or second compensating part has a convex or concave contour on one or two surfaces, which may face away from each other, since easy-to-manufacture disks may then be installed.

If the compensating part is provided, an axial offset may be easily compensated for in addition to an angle offset, if the compensating part is provided with a radial clearance on the particular part. It may therefore be advantageous if the first ball joint is formed on the camshaft side by inserting a compensating part provided with radial clearance, if the first ball joint is formed on the rotor side by inserting a compensating part provided with radial clearance, if the second ball joint is formed on the rotor side by inserting a compensating part provided with radial clearance and/or if the second ball joint is formed on the screw side by inserting a compensating part provided with radial clearance.

A torque or a rotary power is transmitted from the rotor to the inner camshaft via the two ball joints. It may be structurally intended that, for the purpose of a low-loss compensating movement, no or only a limited normal force is present between the rotor and the inner camshaft, and thus no or only a limited ability to transmit torque or rotary power is present. Therefore, a transmission of a high torque may only be desirable at a limited transmittable torque. This may be assisted by providing a form fit between the rotor and the inner camshaft. It may therefore be advantageous if a toothing is formed on the inner camshaft, and if a diametrically opposed or complementary toothing is formed on the rotor, the teeth of the toothings being formed to permit a wobbling movement of the rotor relative to the inner camshaft around the first ball joint. For example, the teeth may have a rounded shape. The teeth may also have a spherical shape. In a further refinement, the camshaft-side toothing may be formed on the end face of the camshaft. Correspondingly, the rotor-side toothing may be formed on the end face of the rotor. It is thus advantageous if a toothing is present on the inner camshaft, a diametrically opposed toothing being formed on the rotor, and the teeth being formed to permit a wobbling movement of the rotor relative to the inner camshaft around the first joint.

To transmit a preferably high torque between the rotor and the inner camshaft, it is advantageous if a preferably high normal force is present between the rotor and the inner camshaft. For this purpose, it is advantageous if a permissible surface pressure is not exceeded. It is therefore advantageous if a ball joint surface of the first joint is designed to have approximately the same contour as a ball joint surface of the second joint, and/or if a radius of the first ball joint is approximately equal to a radius of the second ball joint. It is also advantageous and additionally or alternatively claimable if a ball joint surface of the first ball joint is approximately equal to a ball joint surface of the second ball joint. It is preferable if a portion in the axial direction of the ball joint surface of the first ball joint is approximately equal to a portion in the axial direction of the ball joint surface of the second ball joint. A deviation of less than 30% is preferred both for the approximate equivalence of the radii of the ball joints and for the approximate equivalence of the ball joint surfaces of the ball joints. A deviation of less than 15% is even more preferred, and a deviation of less than 7.5% is most preferred. The deviation of the radii and, in particular, of the ball joint surfaces should preferably be measured, assuming axially ideally aligned camshafts, to ensure a comparability. From a technical perspective, the equivalence/similarity of the surfaces forming one joint is of great advantage. However, it is not absolutely necessary to correspondingly coordinate the surfaces of the two joints with respect to each other.

The present invention also relates to a camshaft adjuster-camshaft combination, including a camshaft adjuster according to the present invention, the outer camshaft being rotatably fixedly fastened to the stator, and the inner camshaft being rotatably fixedly fastened to the rotor.

In other words, it is described to expand the prior art to the effect that an additional ball joint or two additional rounded areas, are provided, namely between the screw head and a mating surface formed on the rotor. This means that two ball joints having a total of four rounded areas on the particular contact surfaces are described. It is thus described to modify the rotor and the camshaft to the effect that they form a ball joint. It is possible to provide the contours or geometries of the ball joint on an additional element. It is also possible to provide or introduce the contours or geometries directly on the particular parts, for example of a camshaft, a rotor and/or a screw. This results in the fact that a double ball joint, so to speak, is formed. Upon the application of an axial force, i.e. during the screwing action, plane-parallel surfaces are therefore no longer present toward which the clamped components may be oriented, due to the (four) rounded areas between the screw and the rotor and between the rotor and the camshaft. The rotor of the camshaft adjuster is thus oriented toward an axial bearing, which is formed, for example, by the stator. The rotor of the camshaft adjuster is thus oriented toward the inner camshaft, i.e., inclined toward the inner camshaft, according to an angle of inclination resulting from the positions of the camshafts with respect to each other. It is particularly preferred if the radii of the particular ball joints have a similar radius, since this facilitates a preferably large or equally large contact surface. A large contact surface permits great pretensioning forces without exceeding the permissible surface pressures. A high torque is thus transmittable between the rotor and the inner camshaft.

BRIEF DESCRIPTION

The present invention is explained below with the aid of five specific embodiments.

DETAILED DESCRIPTION

Figure 1:
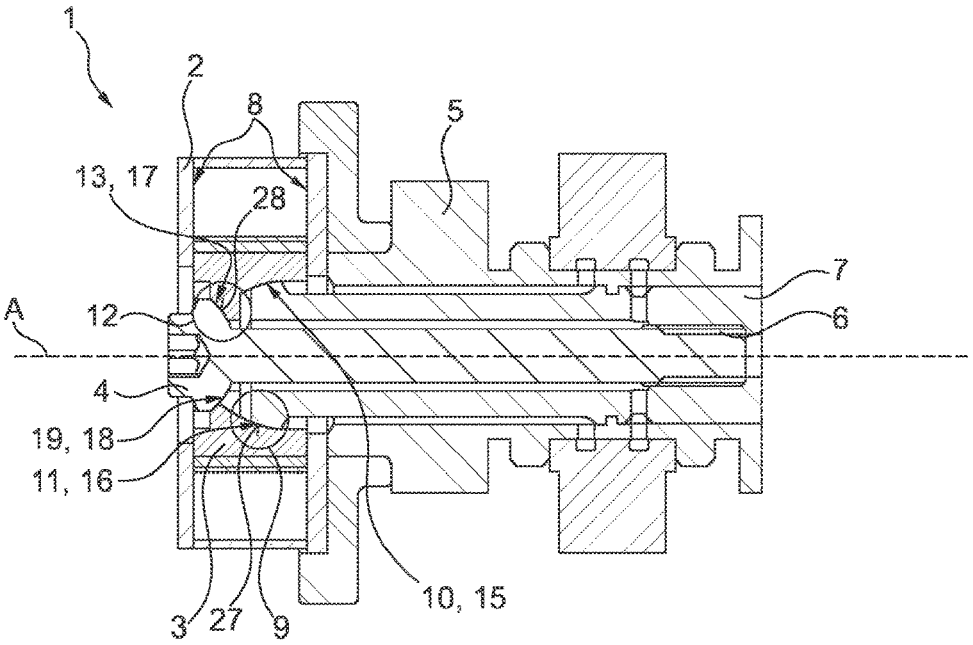
FIG. 1 shows a longitudinal section of a camshaft adjuster according to a first specific embodiment.

The figures are only of a schematic nature and are used only for the sake of understanding the present invention. Identical elements or comparable elements are provided with identical reference numerals. Features of one specific embodiment may also be included in the other specific embodiments. They are thus interchangeable with each other.

A first specific embodiment of the present invention is described on the basis of FIG. 1. FIG. 1 shows a camshaft adjuster 1, which includes a stator 2, a rotor 3 and a screw or central screw 4. Stator 2 is fixedly connected to an outer camshaft 5. Screw 4 is connected to an inner camshaft 7 via a thread 6. Rotor 3 is axially guided on inner walls 8 of stator 2 in an axial direction or in the direction of a rotation axis A of camshaft adjuster 1, which determines the longitudinal direction.

Rotor 3 abuts an end face and/or a lateral surface of inner camshaft 7 via a first joint/ball joint 9. Only an abutment on the lateral surface is apparent in the first exemplary embodiment. A first spherical contact surface 27 is present in first joint/ball joint 9.

A camshaft-side joint contour 10 has a convex shape, and a rotor-side joint contour 11 has a concave shape. Moreover, screw 4 abuts rotor 3 via a second joint/ball joint 12. A rotor-side joint contour 13 has a concave shape, and a screw-side joint contour 14 (see FIG. 2 in this regard) has a convex shape. A second spherical contact surface 28 is present in second joint/ball joint 12.

In the first specific embodiment, first ball joint 9 is formed as a single piece by inner camshaft 7 on the camshaft side, i.e., camshaft-side joint contour 10 is a surface of inner camshaft 7. First ball joint 9 is also formed as a single piece by rotor 3 on the rotor side, i.e., rotor-side joint contour 11 is a surface of rotor 3. Second ball joint 12 is formed as a single piece by rotor 3 on the rotor side, i.e., rotor-side joint contour 13 is a surface of rotor 3. Second ball joint 12 is also formed as a single piece by screw 4 on the screw side, i.e., a screw-side joint contour is a surface of screw 4.

The illustration in FIG. 1 shows outer camshaft 5 and inner camshaft 7 in an ideally aligned manner, i.e., a center axis of outer camshaft 5 and a center axis of inner camshaft 7 are both situated coaxially on the sketched longitudinal axis A. This is done for representation purposes. If an angle error or an angle offset occurs between outer camshaft 5 and inner camshaft 7, rotor 3 may execute a wobbling movement around the inner camshaft on first ball joint 9 and on second ball joint 12. Rotor 3 is guided by stator 2.

Camshaft-side joint contour 10 is formed by a surface 15 of inner camshaft 7, which projects radially from inner camshaft 7. This designation, "radially projecting surface," of surface 15 is not to be understood to mean that camshaft-side joint contour 10 is essentially in a radial plane but that surface 15 projects outwardly radially from a main body of inner camshaft 7. This terminology is furthermore used to make a distinction from an end face described below. Accordingly, rotor-side joint contour 11 is a radial inner surface of rotor 3. The description of radial surface 15 of inner camshaft 7 applies to radial inner surface 16 of rotor 3 in a diametrically opposed or complementary manner. In contrast, rotor-side joint contour 13 is formed by an end face 17 of rotor 3, and screw-side joint contour 14 is formed by an end face 18 of screw 4.

Figure 2:
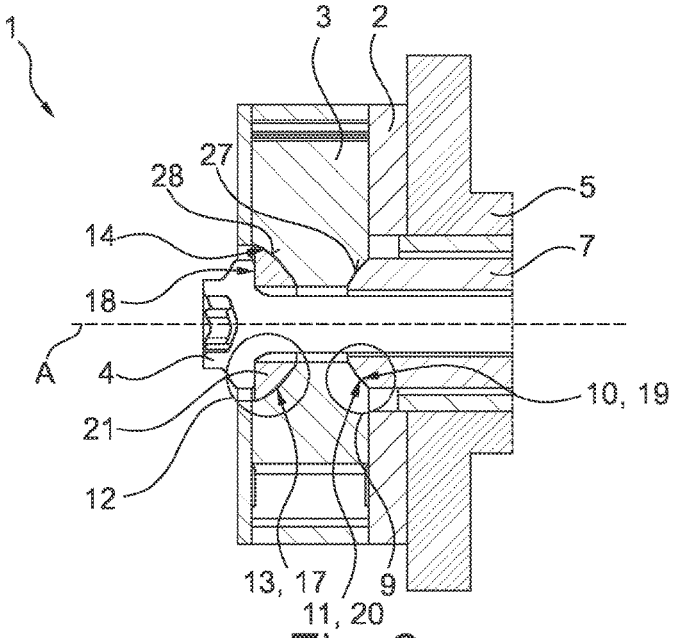
FIG. 2 shows a longitudinal section of a camshaft adjuster according to a second specific embodiment.

A second specific embodiment of the present invention is described on the basis of FIG. 2. In this second specific embodiment, camshaft-side joint contour 10 is formed by an end face 19 of inner camshaft 7, and rotor-side joint contour 11 of first ball joint 9 is formed by an end face 20 of rotor 3 facing inner camshaft 7. In second ball joint 12, rotor-side joint contour 13 is again formed by end face 17 of rotor 3.

In the second specific embodiment, end face 18 of screw 4 is essentially formed around rotation axis A in a radial plane. A compensating part 21 is provided between end face 18 and rotor-side joint contour 13. A planar surface of compensating part 21 abuts end face 18 of screw 4. Screw-side joint contour 14 is formed on compensating part 21. Joint contour 14 of compensating part 21 thus abuts joint contour 13 of rotor 3. In other words, second ball joint 12 is formed as a single piece by rotor 3 on the rotor side and is formed on the screw side by inserting compensating piece 21.

In other respects, the description of the first specific embodiment applies.

Figure 3:
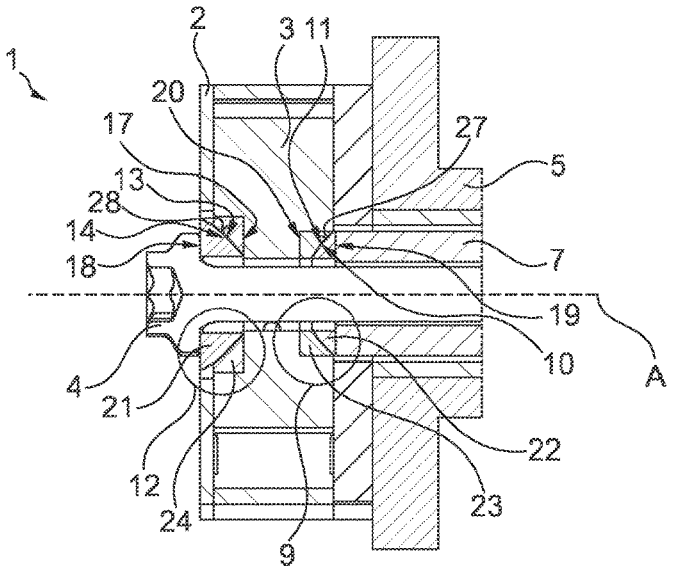
FIG. 3 shows a longitudinal section of a camshaft adjuster according to a third specific embodiment.

A third specific embodiment of the present invention is described on the basis of FIG. 3. In this third specific embodiment, first ball joint 9 is formed on the camshaft side by inserting a compensating part 22 and is formed on the rotor side by inserting a compensating part 23. Second ball joint 12 is furthermore formed on the rotor side by inserting compensating part 24 and is formed on the screw side by inserting a compensating part 21. This means that end face 19 of inner camshaft 7 abuts compensating part 22, end face 20 of rotor 3 abuts compensating part 23, compensating part 22 forms camshaft-side joint contour 10, compensating part 23 forms rotor-side joint contour 11 and camshaft-side joint contour 10 of compensating part 22 abuts rotor-side joint contour 11 of compensating part 23.

In second ball joint 12, end face 17 of rotor 3 abuts compensating part 24, end face 18 of screw 4 abuts compensating part 21, compensating part 21 forms screw-side joint contour 14, compensating part 24 forms rotor-side joint contour 13 and rotor-side joint contour 13 of compensating part 24 abuts screw-side joint contour 14 of compensating part 21.

An axial component of first ball joint 9, or a surface portion of first ball joint 9 which is normal to the longitudinal direction, is approximately the same or of the same size as an axial component of second ball joint 12 or a surface portion of second ball joint 12 which is normal to the longitudinal direction. A surface pressure of joint contours 10, 11, 13, and 14, which is generated by an axial force between screw 4 and inner camshaft 7, is therefore approximately the same or of the same size.

In other respects, the descriptions of the preceding specific embodiments apply.

Figure 4:
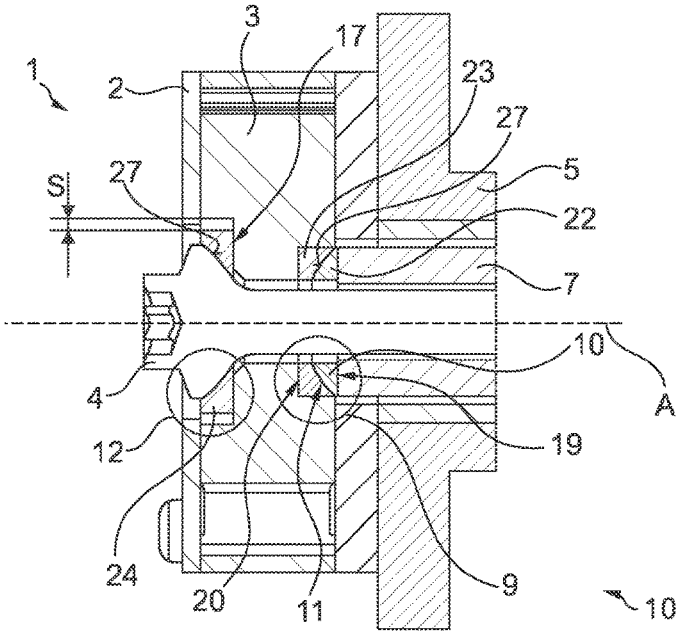
FIG. 4 shows a longitudinal section of a camshaft adjuster according to a fourth specific embodiment.

A fourth specific embodiment of the present invention is described on the basis of FIG. 4. In this fourth specific embodiment, first ball joint 9 is formed on the camshaft side by inserting compensating part 22 and is formed on the rotor side by inserting compensating part 23.

In this fourth specific embodiment, second ball joint 12 is formed on the rotor side by inserting compensating part 24 and is formed as a single piece by screw 4 on the screw side. Compensating part 24 abuts end face 17 of rotor 3. A gap S is provided between rotor 3 and compensating part 24 in the radial direction. Due to gap S, compensating part 24 may slide on end face 17. This prevents a constraining force from being transmitted from screw 4 to rotor 3 via compensating part 24 in the radial direction in the event of a great angle offset between inner camshaft 7 and outer camshaft 5.

In other respects, the descriptions of the preceding specific embodiments apply.

Figure 5:
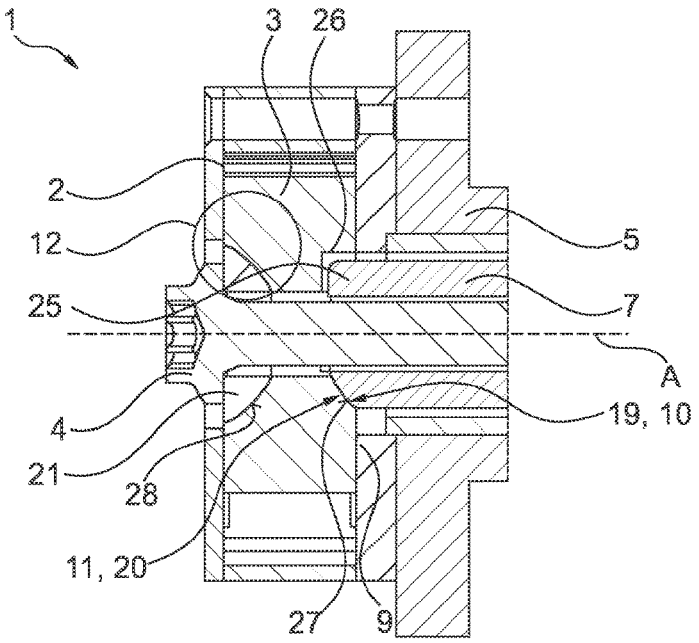
FIG. 5 shows a longitudinal section of a camshaft adjuster, including a rotor and a stator, according to a fifth specific embodiment.
Figure 6:
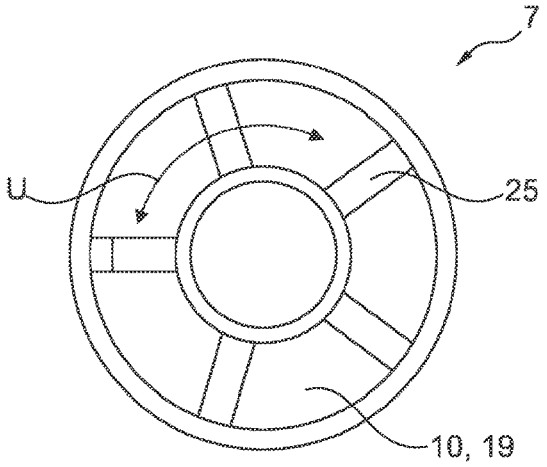
FIG. 6 shows a top view of an end face of the inner camshaft facing the rotor according to the fifth specific embodiment

A fifth specific embodiment of the present invention is described on the basis of FIGS. 5 and 6. In this fifth specific embodiment, second ball joint 12 is formed as a single piece by rotor 3 on the rotor side and is formed on the screw side by inserting compensating part 21.

A toothing 25 is formed on inner camshaft 7. More specifically, camshaft-side toothing 25 is formed on end face 19 of inner camshaft 7. Camshaft-side joint contour 10 is formed on end face 19 of inner camshaft 7 between the individual teeth of toothing 25 in the circumferential direction. This means that first ball joint 9 is formed as a single piece by inner camshaft 7 on the camshaft side.

A toothing 26, which is diametrically opposed or complementary to toothing 25, is formed on end face 20 of rotor 3, which faces inner camshaft 7. End face 20 of rotor 3 forms rotor-side joint contour 11 between the teeth of toothing 26 in the circumferential direction. This means that first ball joint 9 is formed as a single piece by rotor 3 on the rotor side.

In the fifth specific embodiment, therefore, first ball joint 9 and second ball joint 12 facilitate a wobbling movement of rotor 3 relative to inner camshaft 7. A torque or a rotary power may be transmitted between rotor 3 and inner camshaft 7 via camshaft-side toothing 25 and rotor-side toothing 26.

FIG. 6 shows a top view of end face 19 of inner camshaft 7. Camshaft-side joint contour 10 and camshaft-side toothing 25 are apparent. In the fifth specific embodiment, toothing 25 includes, for example, five teeth. This is only an example and should not be understood to be limiting. As is apparent from the illustration in FIG. 6, one tooth of toothing 25 and one surface section of camshaft-side joint contour 10 are each alternately formed on end face 19 of inner camshaft 7 in circumferential direction U.

In other respects, the descriptions of the preceding specific embodiments apply.

Figure 7:
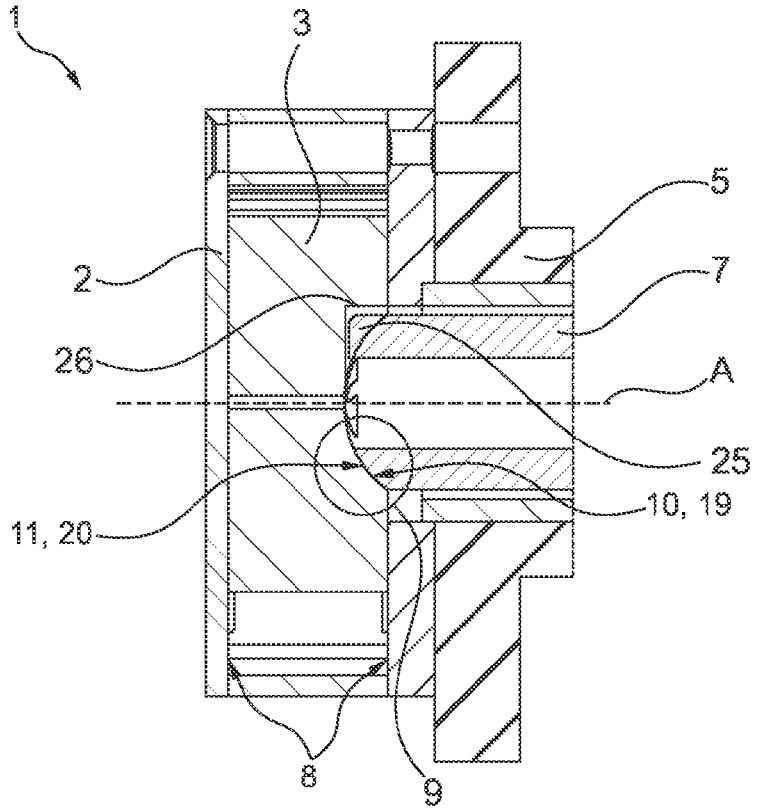
FIG. 7 shows a longitudinal section of one example of the area of the present invention.

FIG. 7 illustrates an example of the area of the present invention. Identical or comparable elements are marked with the same reference numerals and are therefore not described again.

In camshaft adjuster 1 illustrated in FIG. 7, rotor 3 is secured axially, not by a screw or center screw, by only by abutting inner walls 8 of stator 2.

First ball joint 9 is formed as a single piece by inner camshaft 7 on the camshaft side and is formed as a single piece by rotor 3 on the rotor side. This means that end face 19 of inner camshaft 7 forms camshaft-side joint contour 10, and rotor-side end face 20 of rotor 3, which faces inner camshaft 7, forms rotor-side joint contour 11. Toothing 25 is furthermore mounted on camshaft-side end face 19, and toothing 26 is mounted on rotor-side end face 20. Camshaft-side toothing 25 and rotor-side toothing 26 are formed to be diametrically opposed or complementary to each other.

In other words, a difference between the fifth specific embodiment of the present invention and the example illustrated on the basis of FIG. 7 for the area of the present invention is apparent in that rotor 3 of camshaft adjuster 1 illustrated in FIG. 7 is not supported on inner camshaft 7 by an axial force of a screw. Instead, rotor 3 of camshaft adjuster 1 is supported in a floating manner, as illustrated in FIG. 7. The floating bearing, in connection with first ball joint 9, permits a wobbling movement of rotor 3 on inner camshaft 7. In camshaft adjuster 1 of the example illustrated on the basis of FIG. 7 for the area of the present invention, an angle offset between inner camshaft 7 and the outer camshaft 5 may thus be compensated for. At the same time, a torque is transmittable from rotor 3 to inner camshaft 7 via toothings 25 and 26.

In other respects, the descriptions of the preceding specific embodiments apply.

Figure 8:
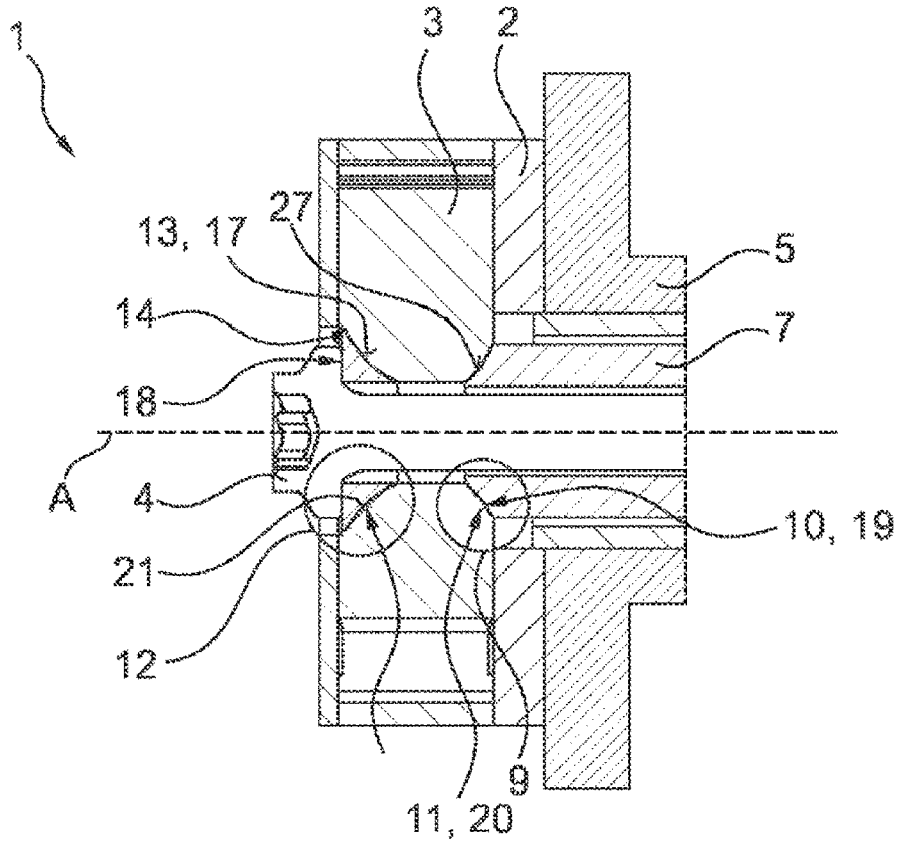
FIG. 8 shows a longitudinal section of a camshaft adjuster according to a sixth specific embodiment.

FIG. 8 shows another embodiment that is configured in the same manner as the embodiment shown in FIG. 2, except camshaft-side joint contour 10 has a concave shape, and rotor-side joint contour 11 has a convex shape, while rotor-side joint contour 13 has a convex shape, and a screw-side joint contour 14 has a concave shape.

LIST OF REFERENCE NUMERALS

1 camshaft adjuster
2 stator
3 rotor
4 screw/center screw
5 outer camshaft
6 thread
7 inner camshaft
8 inner wall
9 first joint/first ball joint
10 camshaft-side joint contour
11 rotor-side joint contour
12 second joint/second ball joint
13 rotor-side joint contour

14 screw-side joint contour
15 radial surface
16 radial inner surface
17 rotor-side end face
18 screw-side end face
19 camshaft-side end face
20 rotor-side end face
21 screw-side compensating part
22 camshaft-side compensating part
23 rotor-side compensating part
24 rotor-side compensating part
25 camshaft-side toothing
26 rotor-side toothing
27 first spherical contact surface
28 second spherical contact surface
A rotation axis
S gap
U circumferential direction

What is claimed is:

1. A camshaft adjuster for variably adjusting an outer camshaft and an inner camshaft situated concentrically thereto, the camshaft adjuster comprising:

a stator configured to be connected to the outer camshaft;

a rotor situated concentrically to the stator, the rotor being configured to be connected to the inner camshaft by a first joint on a first spherical contact surface, and force being applicable to the rotor via a screw for the purpose of axially securing the rotor on the inner camshaft, the screw configured to be connected to the inner camshaft by a second joint on a second spherical contact surface.

2. The camshaft adjuster as recited in claim 1 wherein the first joint or the second joint is formed from a pair of spherically diametrically opposed joint contours.

3. The camshaft adjuster as recited in claim 1 wherein the first joint is formed by a convex joint contour on the camshaft side and a concave joint contour on the rotor side or by a concave joint contour on the camshaft side and a convex joint contour on the rotor side.

4. The camshaft adjuster as recited in claim 1 wherein the second joint is formed by a convex joint contour on the screw side and a concave joint contour on the rotor side or by a concave joint contour on the screw side and a convex joint contour on the rotor side.

5. The camshaft adjuster as recited in claim 1 wherein the rotor is in direct contact with the inner camshaft in the first joint, or a first compensating part is inserted between the rotor and the inner camshaft.

6. The camshaft adjuster as recited in claim 5 wherein the first compensating part has a convex or concave contour on one or two surfaces.

7. The camshaft adjuster as recited in claim 1 wherein the screw is in direct contact with the inner camshaft in the second joint, or a second compensating part is inserted therebetween.

8. The camshaft adjuster as recited in claim 7 wherein the second compensating part is present and has a convex or concave contour on one or two surfaces.

9. The camshaft adjuster as recited in claim 1 wherein a toothing being formed on the rotor that is configured to be diametrically opposed to a toothing present on the inner camshaft, and the toothing on the rotor being formed to permit a wobbling movement of the rotor relative to the inner camshaft around the first joint.

10. A camshaft adjuster-camshaft combination, comprising: a camshaft adjuster as recited in claim 1, the outer camshaft rotatably fixedly attached to the stator, and the inner camshaft rotatably fixedly attached to the rotor.

11. The camshaft adjuster as recited in claim 1 wherein the screw is connectable to the inner camshaft by the second joint via the rotor.

12. The camshaft adjuster as recited in claim 11 wherein the rotor contacts the screw at the second spherical contact surface and the rotor is configured for contacting the inner camshaft at the first spherical contact surface.

13. The camshaft adjuster as recited in claim 11 wherein the rotor contacts a compensating part at the second spherical contact surface.

14. The camshaft adjuster as recited in claim 11 wherein a compensating part contacts the screw at the second spherical contact surface and the rotor contacts the compensating part.

15. The camshaft adjuster as recited in claim 14 wherein the compensating part is arranged and configured with respect to the rotor such that a gap is provided between the rotor and the compensating part in a radial direction such that the compensating part is slidable on an end face of the rotor.

16. The camshaft adjuster as recited in claim 11 wherein two compensating parts contact each other at the first spherical contact surface and the rotor contacts one of the two compensating parts.

17. The camshaft adjuster as recited in claim 11 wherein two compensating parts contact each other at the second spherical contact surface and the rotor contacts one of the two compensating parts.

18. A camshaft adjuster for variably adjusting an outer camshaft and an inner camshaft situated concentrically thereto, the camshaft adjuster comprising:

a stator configured to be connected to the outer camshaft;

a rotor situated concentrically to the stator, the rotor configured to be connectable to the inner camshaft by a first joint on a first spherical contact surface, and force being applicable to the rotor via a screw for the purpose of axially securing the rotor on the inner camshaft, the screw being connected to the rotor by a second joint on a second spherical contact surface.

* * * * *